US007104092B2

(12) United States Patent
Yu

(10) Patent No.: US 7,104,092 B2
(45) Date of Patent: Sep. 12, 2006

(54) SECURITY LOCK WITH DUAL LOCKING MEANS

(76) Inventor: Chun Te Yu, No.253, Sec. 3, Yanhai Rd., Fusing Township, Changhua County (TW) 506

( * ) Notice: Subject to any disclaimer, the term of this patent is extended or adjusted under 35 U.S.C. 154(b) by 0 days.

(21) Appl. No.: 11/126,199

(22) Filed: May 11, 2005

(65) Prior Publication Data

US 2006/0162399 A1 Jul. 27, 2006

(30) Foreign Application Priority Data

Jan. 27, 2005 (TW) ..... 94201564 U

(51) Int. Cl.
*E05B 37/14* (2006.01)
*E05B 65/52* (2006.01)

(52) U.S. Cl. ..... 70/21; 70/30; 70/49; 70/71; 70/284; 70/285

(58) Field of Classification Search ..... 70/2–13, 70/21, 25, 26, 30, 49, 69–72, 31, 74, 284, 70/285, DIG. 37, DIG. 63, DIG. 71
See application file for complete search history.

(56) References Cited

U.S. PATENT DOCUMENTS 1,545,666 A 7/1925 Kornhaber et al.
3,439,515 A * 4/1969 Gehrie ..... 70/288
3,750,431 A 8/1973 Atkinson
3,837,189 A 9/1974 Atkinson
4,325,240 A 4/1982 Gable
4,751,830 A 6/1988 Cheng
4,884,419 A 12/1989 Ling
5,868,012 A * 2/1999 Chun-Te et al. ..... 70/30
6,539,761 B1 4/2003 Yang
6,708,534 B1 3/2004 Ruan
6,843,080 B1 1/2005 Yu
6,848,283 B1 2/2005 Lin
6,860,125 B1 3/2005 Yu
6,877,345 B1 4/2005 Misner et al.
6,880,370 B1 4/2005 Yu
6,904,776 B1 * 6/2005 Lin ..... 70/25
6,912,880 B1 * 7/2005 Ling et al. ..... 70/71
7,003,988 B1 2/2006 Yu
7,007,520 B1 * 3/2006 Lin ..... 70/21
2002/0088256 A1 7/2002 Taylor et al.
2004/0226323 A1 11/2004 Ling et al.
2004/0226324 A1 11/2004 Loughlin et al.
2004/0255624 A1 12/2004 Loughlin et al.
2005/0034492 A1 2/2005 Yu (Continued)

*Primary Examiner*—Lloyd A. Gall
(74) *Attorney, Agent, or Firm*—Rosenberg, Klein & Lee

(57) ABSTRACT

A security lock that can be unlocked by the owner of the security lock by dialing an unlocking number or by authorized security personals with a general key. The security lock mainly contains: a lock body, a plugging device, a controlling device, a securing mechanism, a restriction device, a first locking device and a second locking means. The lock body has a first channel and a second channel therein. The plugging device is pluggable into the first channel. The controlling device is slidably secured within the second channel. The securing mechanism is for securing or releasing the plugging device. The restriction device is slidably deposed within the second channel against the controlling device for controlling movement thereof. The first locking device is formed in the lock body for being engaged with or disengaged from the restriction device. The second locking device is formed in the lock body for rotating the restriction device to be disengaged from the first locking device.

10 Claims, 11 Drawing Sheets

U.S. PATENT DOCUMENTS

2005/0039500 A1 2/2005 Yu
2005/0044901 A1 3/2005 Yu
2005/0092036 A1 5/2005 Lai
2005/0262902 A1* 12/2005 Ling et al. ..... 70/21

* cited by examiner

SECURITY LOCK WITH DUAL LOCKING MEANS

TECHNICAL FIELD

This invention relates generally to a security lock, in particular, to provide a security lock with dual locking means.

BACKGROUND OF THE INVENTION

Preventing personal stuffs from being lost or stolen, travelers usually lock their own travel baggage boxes. Combination lock is the most common lock that installed in a travel baggage box because it takes little space. Each traveler sets up his own security number for the combination lock. Thereby others without knowing the security number cannot unlock his baggage box. However terrorists may use travel baggage boxes to deliver explosive devices to endanger people's safety. Security personals in airports may need to exam travels' travel baggage boxes in some circumstances without presence of the owners of the travel baggage boxes. Some countries require travelers not to lock their travel baggage boxes. The travelers may lose their properties in their travel baggage boxes if they leave their travel baggage boxes unlocked. If they choose to lock their baggage boxes, the security personals are authorized to damage the travel baggage boxes in order to exam objects inside of the travel baggage boxes. There is a dilemma between travelers' rights and flight safety. Therefore, a security lock that can protect travels' properties and allow security personals to unlock the security lock is needed as well.

SUMMARY OF INVENTION

It is therefore an objective of the present invention to provide a security lock that can be unlocked by the owner of the security lock by dialing an unlocking number or by authorized security personals with a general key.

The present invention, briefly summarized, in one embodiment discloses a security lock with dual locking means. The security lock mainly comprises: a lock body, a plugging device, a controlling device, a securing mechanism, a restriction device, a first locking means and a second locking means. The lock body has a first channel and a second channel therein. The plugging device is pluggable into the first channel. The controlling device is slidably secured within the second channel. The securing mechanism is for securing or releasing the plugging device. The restriction device is slidably deposed within the second channel against the controlling device for controlling movement thereof. The first locking means is formed in the lock body for being engaged with or disengaged from the restriction device. The second locking means is formed in the lock body for rotating the restriction device to be disengaged from the first locking means. Wherein when the restriction device is disengaged from the first locking means, the controlling device can be moved to drive the securing mechanism to release the plugging device and when the restriction device is secured by the first locking means, the second locking means can be driven by a key to have the restriction device rotated to be disengaged from the first locking means.

BRIEF DESCRIPTION OF DRAWINGS

The invention will be more clearly understood after referring to the following detailed description read in conjunction with the drawings wherein.

DETAILED DESCRIPTION OF PREFERRED EMBODIMENTS

Figure 1:
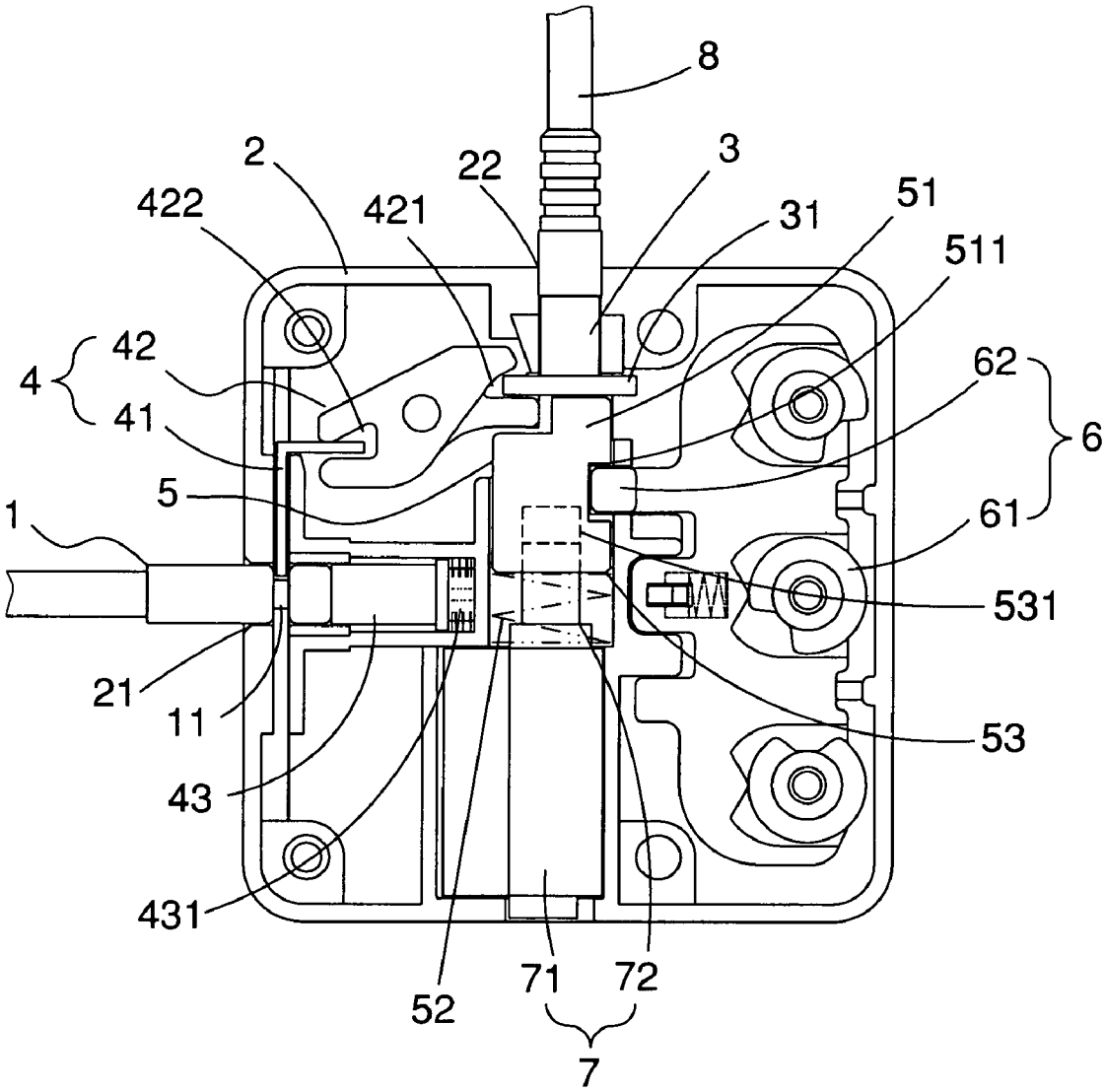
FIG. 1 is a cross sectional view of the first embodiment of present invention wherein the plugging device is secured by the securing mechanism.

Please refer to FIG. 1 which shows a first embodiment of the present invention. The security lock mainly comprises: a lock body 2, a plugging device 1, a controlling device 3, a securing mechanism 4, a restriction device 5, a first locking means 6, a second locking means 7 and a cable 8 connected to the plugging device 1 with one end and connected to the controlling device 3 with the other end. The lock body 2 has a first channel 21 and a second channel 22 therein. The plugging device 1 is pluggable into the first channel 21. The controlling device 3 is slidably secured within the second channel 22. The securing mechanism 4 is for securing or releasing the plugging device 1. The restriction device 5 is slidably deposed within the second channel 22 against the controlling device 3 for controlling movement thereof. The first locking means 6 is formed in the lock body 2 for being engaged with or disengaged from the restriction device 5. The second locking means 7 is formed in the lock body 2 for rotating the restriction device 5 to be disengaged from the first locking means 6 whereby when the restriction device 5 is disengaged from the first locking mechanism 6, the controlling device 3 can be moved to drive the securing mechanism 4 to release the plugging device 1 and when the restriction device 5 is secured by the first locking means 6, the second locking means 7 can be driven by a key to have the restriction device 5 rotated to be disengaged from the first locking means 6.

Figure 3:
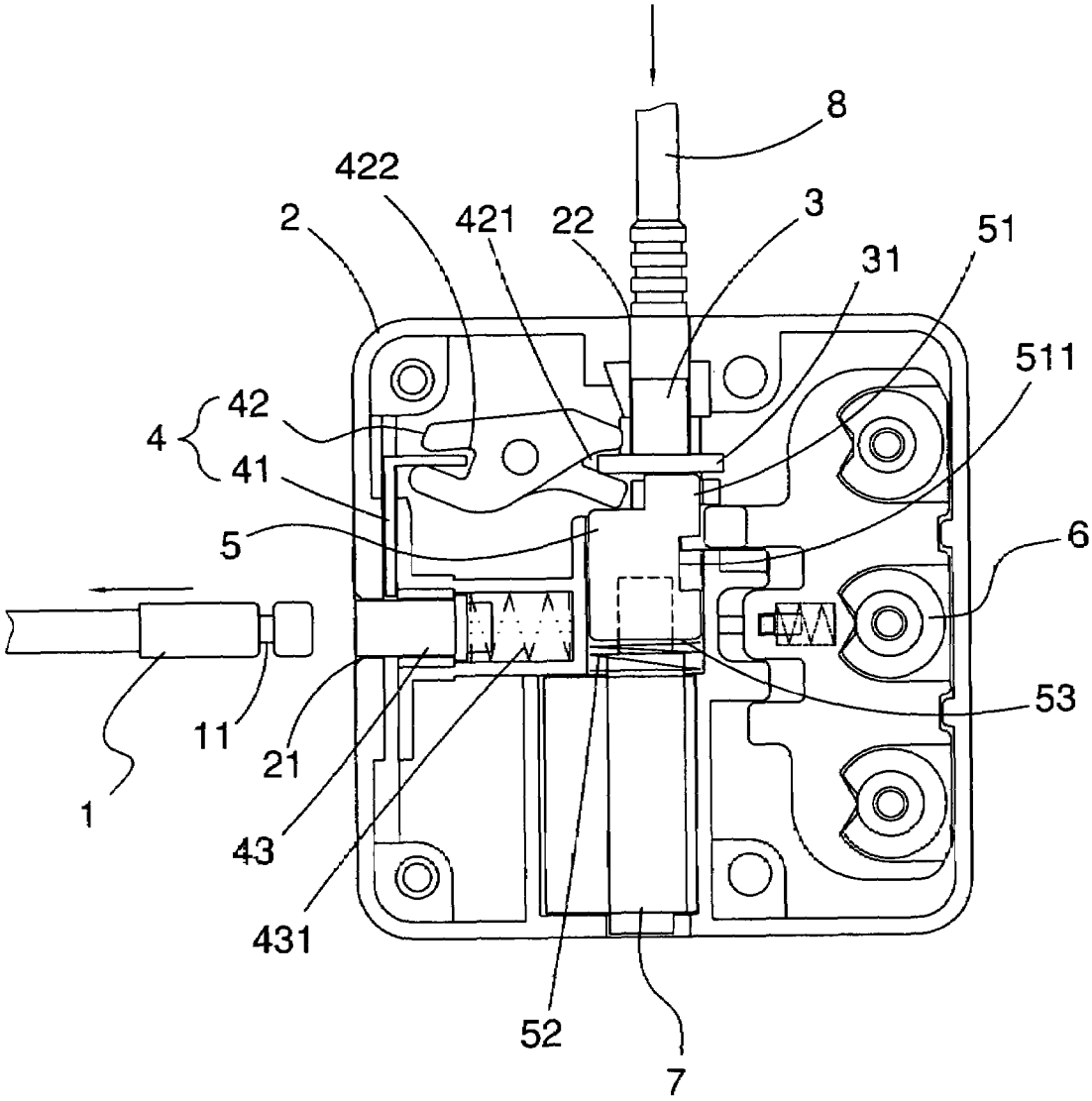
FIG. 3 is a cross sectional view of the first embodiment of present invention wherein the plugging device is released from the securing mechanism.
Figure 5:
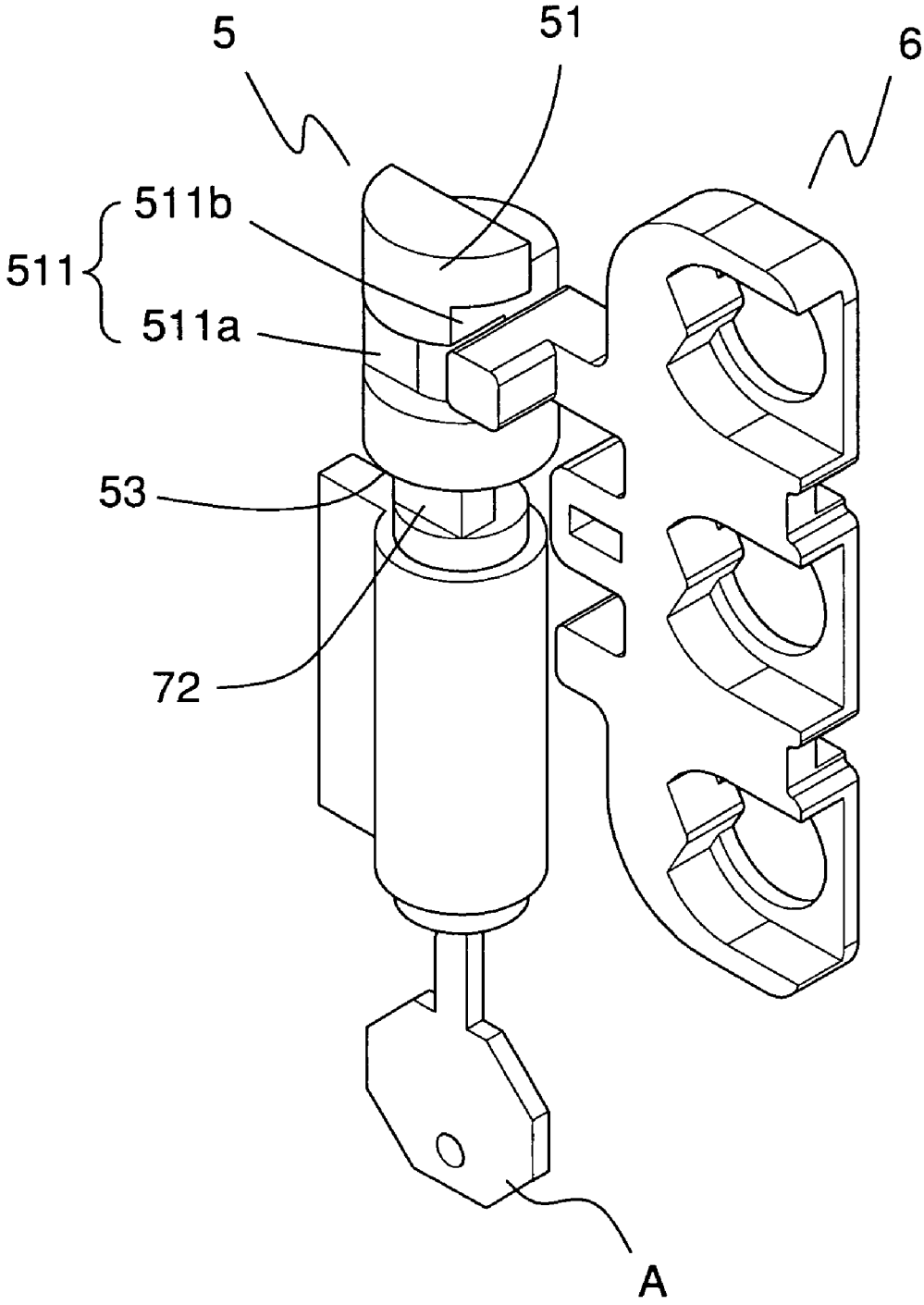
FIG. 5 is a detailed view in part of the first embodiment wherein the moving element is within the wide section of the gap before the restriction device is moved downwardly.

With reference to FIG. 1, FIG. 3, and FIG. 5, the restriction device 5 has a cylinder surface 51, and a bottom surface 53 having a cave 531 therein. The cylinder surface 51 has a gap 511 therein. The gap 511 has a narrow section 511*a* and wide section 511*b*. The first locking means 6 comprises a combination locking means with plural number wheels 61 and a moving element 62. The moving element 62 is movable when the plural number wheels 61 are dialed to unlocking numbers. The second locking means 7 is a key operated locking means having a body 71 and a rotor 72 extended therefrom and engaged with the cave 531 of the bottom surface 53 for rotating the restriction device 5 to be engaged with or disengaged from the moving element 62 of the first locking means 6 wherein when the moving element 62 is within the narrow section 511*a* of the gap 511, the restriction device 5 is engaged with the moving element 62 and the moving element 62 is held within the narrow section 511*a* of the gap 511. The wide section 511*b* of the gap 511 provides sufficient space for the restriction device 5 to move vertically while the moving element 62 is within the gap 51. When the moving element 62 is within the wide section 511*b* of the gap, the restriction device 5 is disengaged from the moving element 62 and the moving element 62 is movable vertically.

With reference to FIG. 1, and FIG. 3, a compression spring 52 is deposed on top of the body 71 of the key operated locking means 7, surrounding the rotor 72 and against the bottom surface 53 of the restriction device 5 whereby the compression spring 52 can restore the restriction device 5 to its original position after the restriction device 5 is moved downward by the controlling device 3 to drive the securing mechanism 4 to release the plugging device 1.

With reference to FIG. 1 and FIG. 3, the securing mechanism 4 has a securing element 41 for securing or releasing the plugging device 1 and a driving element 42 engaged with the restriction element 41 for driving the same. The plugging device 1 has a neck portion 11 for being engaged with the securing element 41. The controlling device 3 has a flange 31 at the end thereof engaged with a second aperture 421 at the second end of the driving element 42. The driving element 42 has a first aperture 422 at the first end engaged with the securing element 41. An ejecting mechanism 43 comprising a compression spring 431 is installed in the first channel 21 for ejecting the plugging device 1 when the securing element 41 is disengaged from the neck portion 11 of the plugging device 1.

Figure 2:
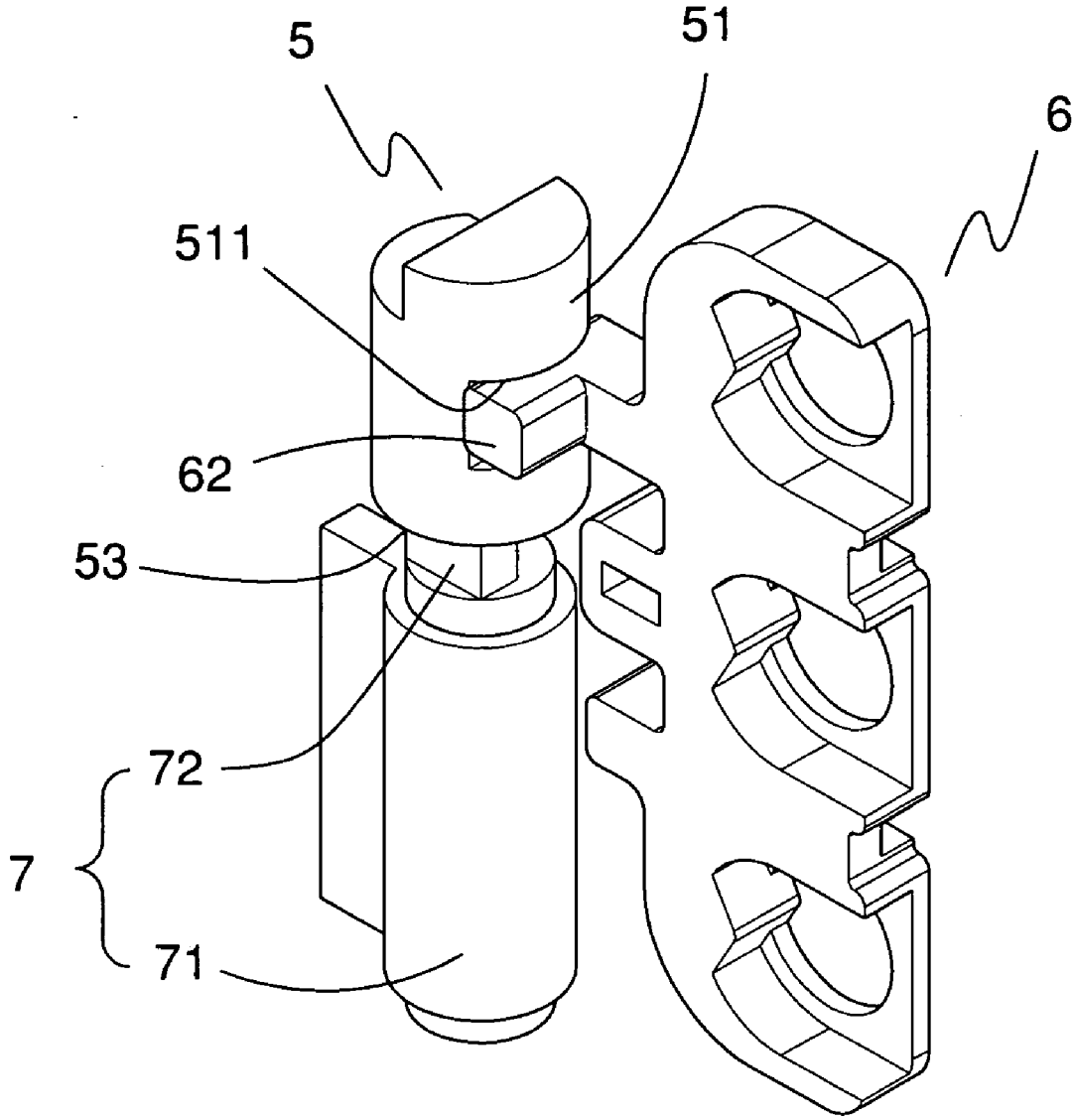
FIG. 2 is a perspective view of the first embodiment that the moving element is engaged with the gap of the restriction device and prevent the movement thereof.

With reference to FIG. 1 and FIG. 2, before the plural number wheels 61 are dialed to the unlocking number, the moving element 62 of the first locking means 6 remains in the narrow section 511*a* of the gap 511 of the restriction device 5 and is not movable. Referring to FIG. 3, after plural number wheels 61 are dialed to the unlocking number, the moving element 62 is removed from the gap 511 and the controlling device 3 is moved downward to drive the driving element 42 turn clockwise and push the restriction device 5 move downward to compress the compression spring 52. Turning clockwise, the driving element 42 lifts the restricting element 41 and release the plugging device 1 from the first channel 21 and the ejecting mechanism 43 ejects the plugging device 1 out of the first channel 21.

Figure 4:
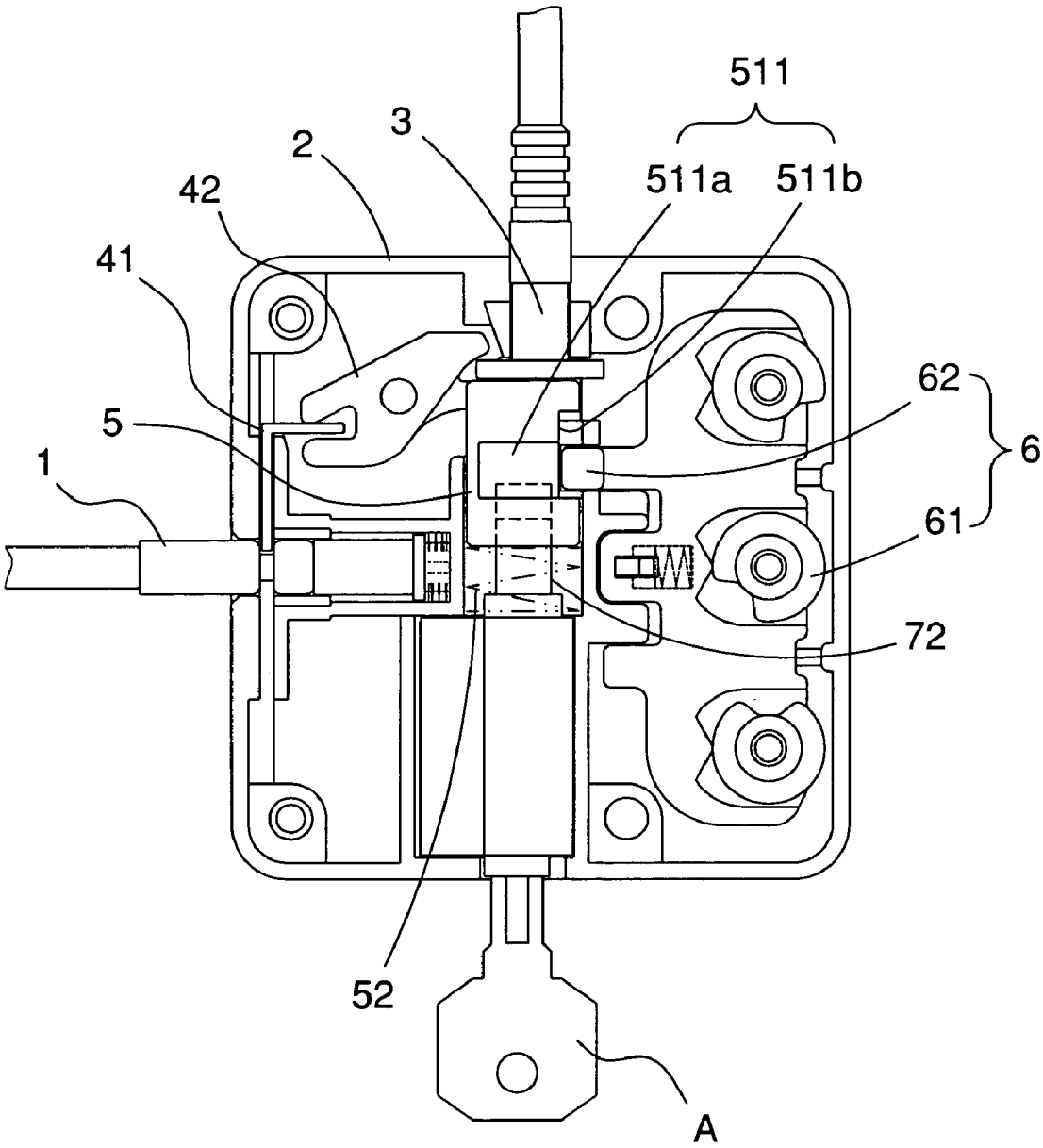
FIG. 4 is a cross sectional view of the first embodiment of present invention wherein the key operated locking means is operated by a key and the restriction device is rotated to a position that the moving element is within the wide section of the gap.

With reference to FIG. 4 and FIG. 5, the plural number wheels 61 are not dialed to the unlocking number, the moving element 62 of the first locking means 6 is not movable. A key A is inserted to the key operated locking means 7 and the key A turns the rotor 72 together with the restriction device 5 from a position that the moving element 62 is within the narrow section 511*a* of the gap 511 to the wide section 511*b* of the gap 511, whereby the restriction device 5 is movable vertically since the moving element 62 can no longer restrain the movement of the restriction device 5.

Figure 6:
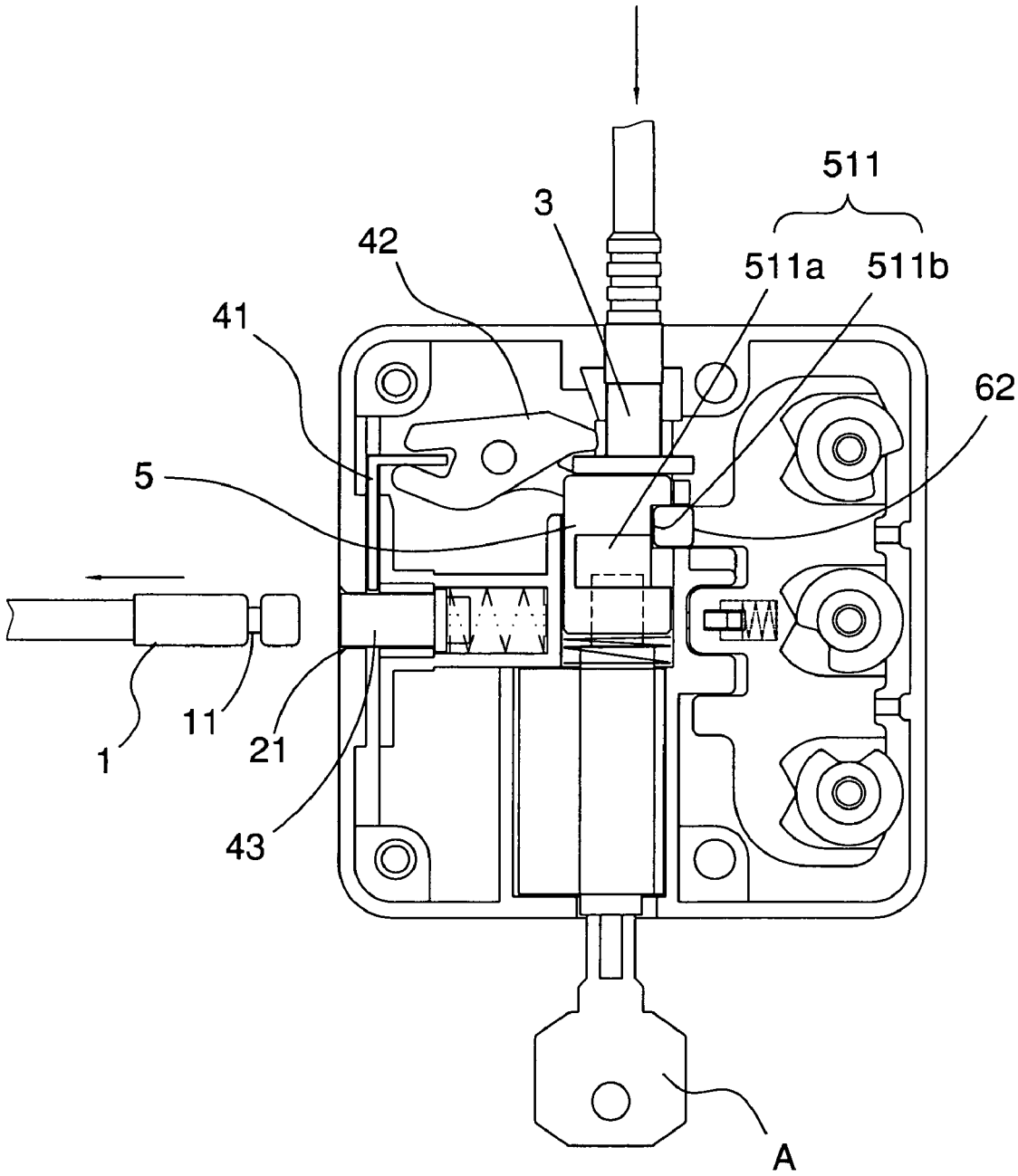
FIG. 6 is a perspective view of the first embodiment wherein the moving element is within the wide section of the gap and the restriction device is moved downward to drive the securing mechanism.
Figure 7:
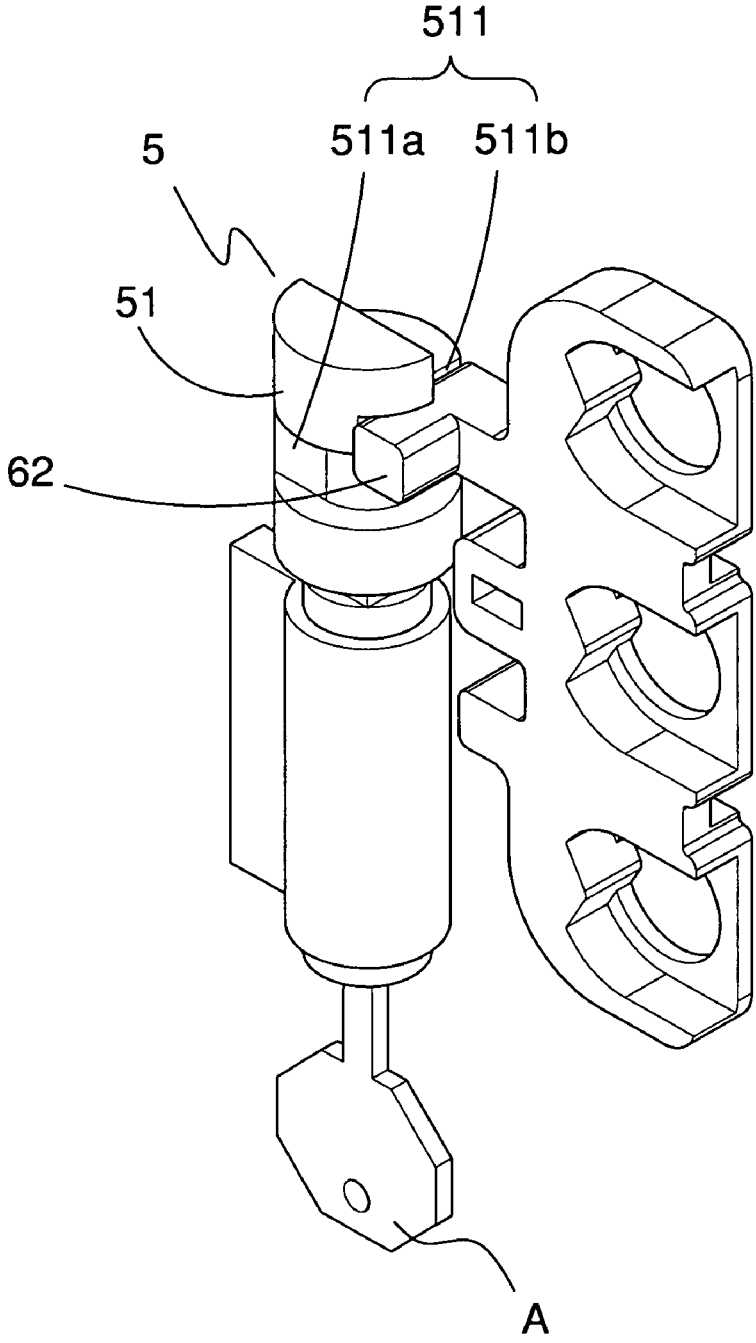
FIG. 7 is a detailed view in part of the first embodiment wherein the moving element is within the wide section of the gap after the restriction device is moved downwardly

With reference to FIG. 6, after the key A turns the rotor 72 together with the restriction device 5 to a position that the moving element 62 in within the wide section 511*b* of the gap 511, the controlling device 3 is moved downward to drive the driving element 42 turn clockwise and push the restriction device 5 move downward to compress the compression spring 52. Turning clockwise, the driving element 42 lifts the restricting element 41 and release the plugging device 1 from the first channel 21 and the ejecting mechanism 43 ejects the plugging device 1 out of the first channel 21.

Figure 8:
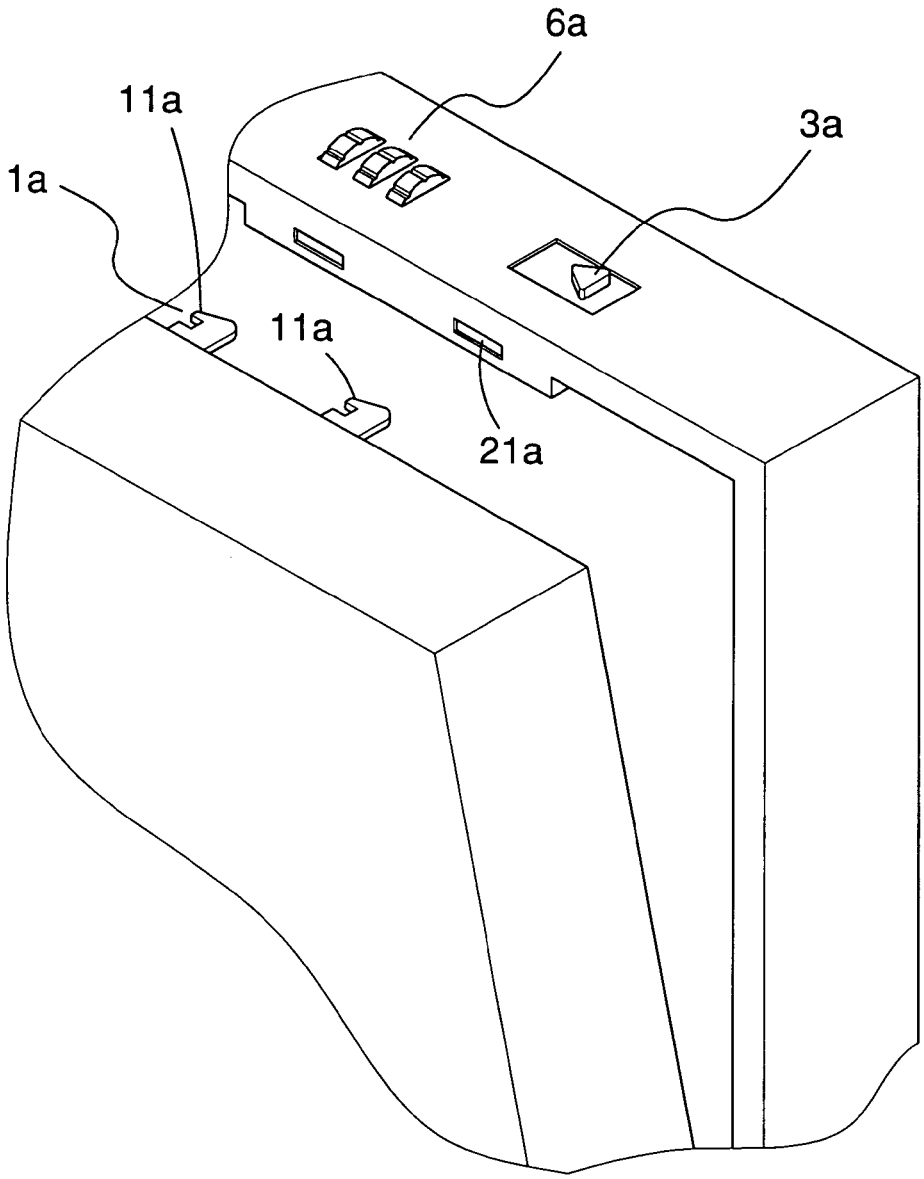
FIG. 8 is a perspective view of the second embodiment that installed in a luggage case.
Figure 9:
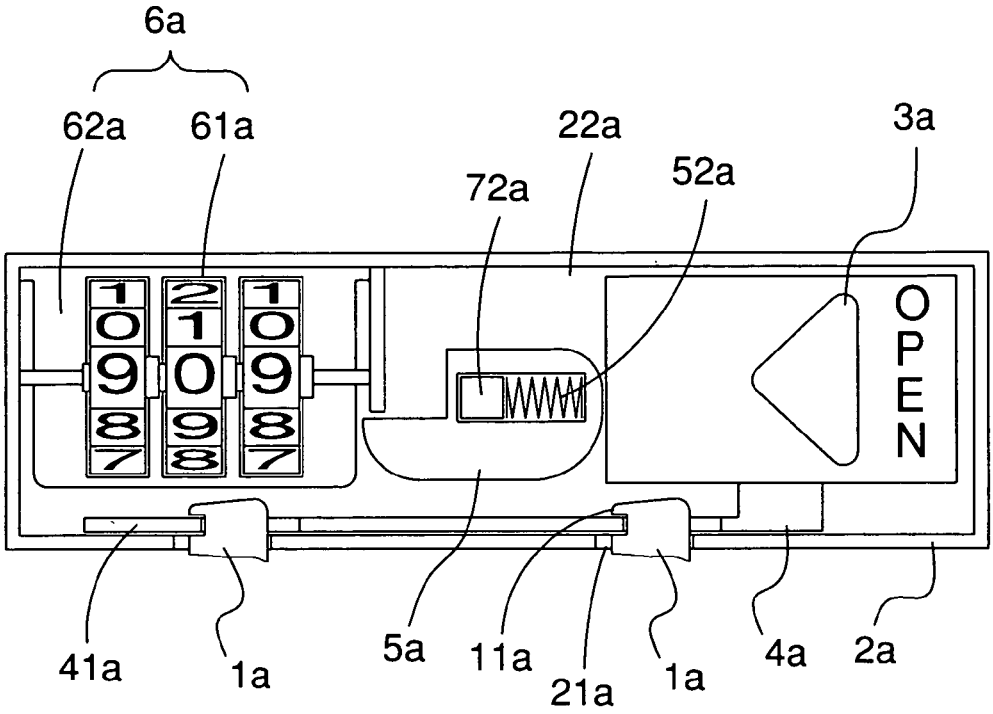
FIG. 9 is a cross sectional view of the second embodiment wherein the controlling device is not movable when the plural number wheels are not dialed to unlocking numbers.
Figure 10:
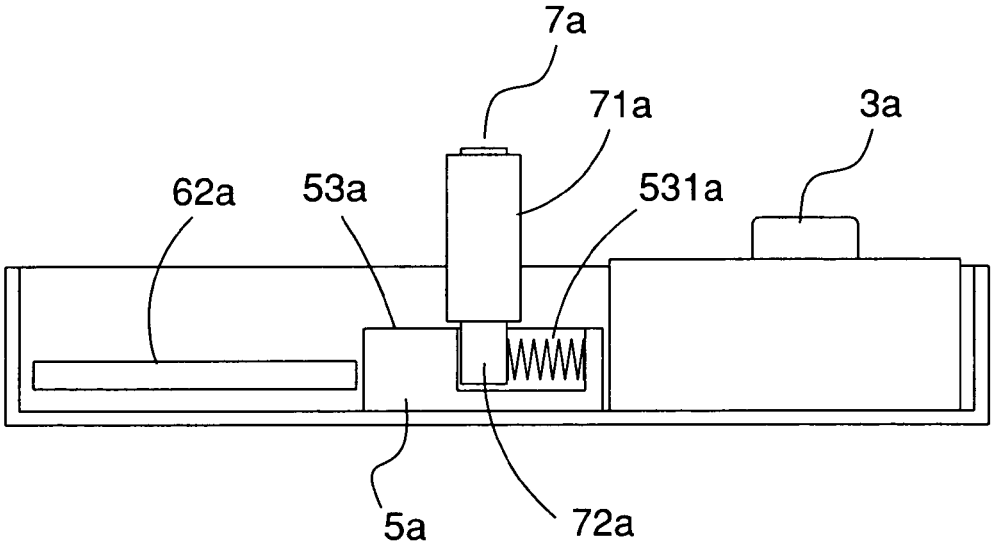
FIG. 10 is another cross sectional view of the second embodiment wherein the controlling device is not movable when the plural number wheels are not dialed to unlocking numbers.

FIG. 8 to FIG. 10, illustrate the second embodiment of the present invention that installed in a luggage case. The second embodiment comprises a lock body 2*a* installed in the luggage case body, a plugging device 1*a* installed at the edge of the cover of the luggage case, a controlling device 3*a*, a securing mechanism 4*a*, a restriction device 5*a*, a first locking means 6*a*, a second locking means 7*a*. The restriction device 5*a* has a top surface 53*a* having a cave 531*a* therein. The first locking means 6*a* comprising a combination locking means having a moving element 62*a* and plural number wheels 61*a* for controlling the moving element 62*a* to be engaged with or disengaged from the restriction device 5*a*. The moving element 62*a* is disengaged from the restriction device 5*a* when the plural number wheels 61*a* are dialed to unlocking numbers. The second locking means 7*a* is a key operated locking means having a body 71*a* and a rotor 72*a* extended therefrom. The body 71*a* of the key operated locking means 7*a* is fixed in the lock body 2*a*. The rotor 72*a* is engaged with the cave 531*a* of the top surface 53*a* for rotating the restriction device 5*a* to be departed from against the controlling device 3*a* whereby the controlling device 3*a* can drive the securing mechanism 4*a* to secure or release the plugging device 1*a*.

The lock body 2*a* has a first channel 21*a* and a second channel 22*a* therein. The plugging device 1*a* is pluggable into the first channel 21*a*. The controlling device 3*a* is slidably secured within the second channel 22*a*. The securing mechanism 4*a* is for securing or releasing the plugging device 1*a*. The restriction device 5*a* is slidably deposed within the second channel 22*a* against the controlling device 3*a* for controlling movement thereof.

With reference to FIG. 9 to FIG. 12, a compression spring 52*a* is deposed within the cave 531*a* of the top surface 53*a* and is against an inner wall thereof with one end and against the rotor 72*a* of the key operated locking means 7*a* with the other end whereby the compression spring 52*a* can restore the restriction device 5*a* to its original position after being compressed. The securing mechanism 4*a* has a securing element 41*a* connected to the controlling device 3*a* for securing or releasing the plugging device 1*a*. The plugging device 1*a* has a hook portion 11*a* for being engaged with the securing element 41*a*.

Referring to FIG. 9 and FIG. 10, before the plural number wheels 61*a* are dialed to the unlocking number, the moving element 62*a* of the first locking means 6*a* is placed against the restriction device 5*a* and the restriction device 5*a* is placed against both the moving element 62*a* and the controlling device 3*a* at its both sides respectively. Hence the controlling device 3*a* is not movable and the securing mechanism 4*a* remains engaged with the plugging devices 1*a*.

Figure 11:
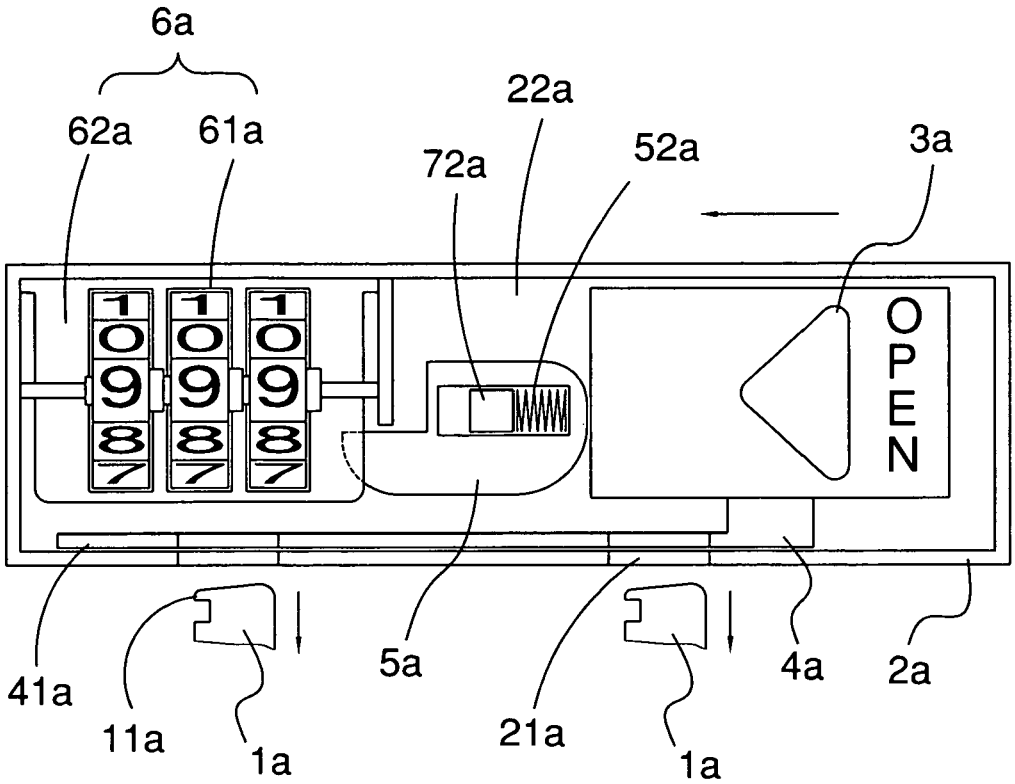
FIG. 11 is a cross sectional view of the second embodiment wherein the controlling device is movable when the plural number wheels are dialed to unlocking numbers.
Figure 12:
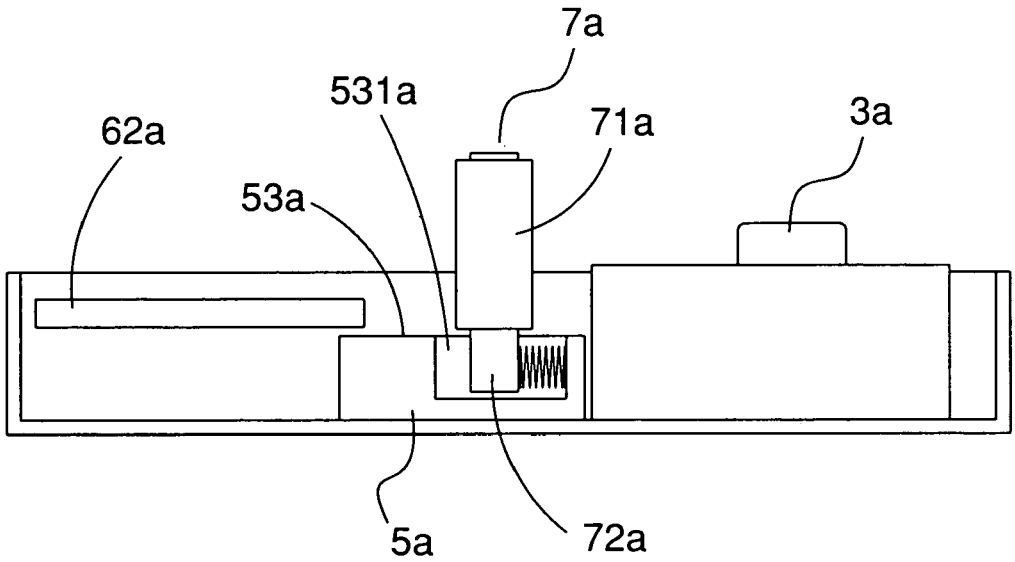
FIG. 12 is another cross sectional view of the second embodiment wherein the controlling device is movable when the plural number wheels are dialed to unlocking numbers and the moving element is disengaged from the restriction device.

With reference to FIG. 11 and FIG. 12, after the plural number wheels 61*a* are dialed to the unlocking number, the moving element 62*a* of the first locking means 6*a* is disengaged from restriction device 5*a*. Accordingly, the controlling device 3*a* together with the restriction device 5*a* are moved leftward along the second channel 22*a* and the securing mechanism 4*a* connected to the controlling device 3*a* releases the plugging devices 1*a*.

Figure 13:
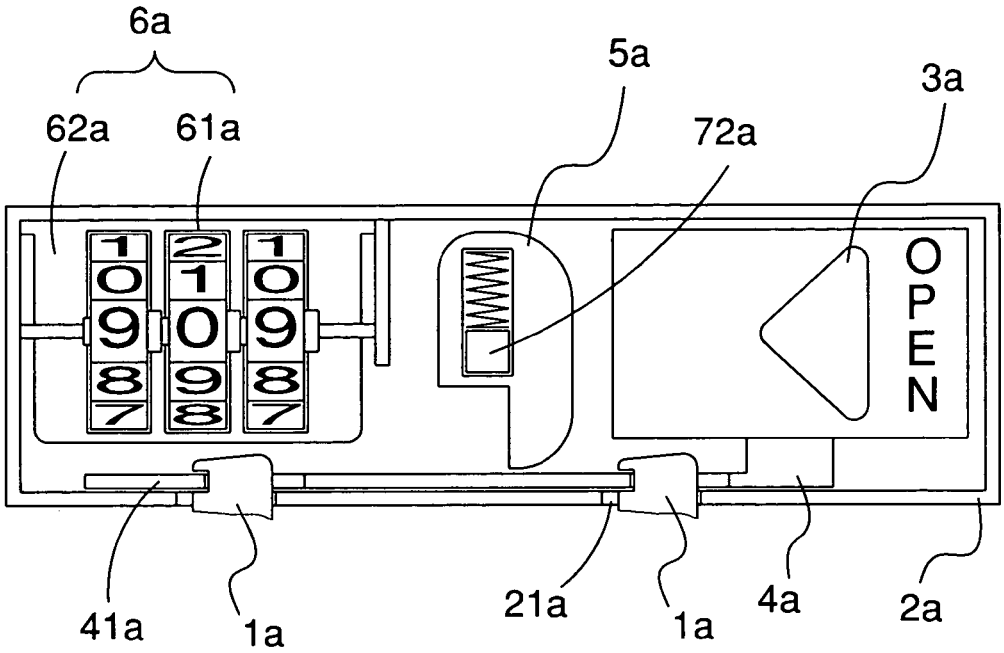
FIG. 13 is a cross sectional view of the second embodiment wherein the restriction device is rotated by a key to a position that the restriction device is departed from against the controlling device whereby the controlling device can drive the securing mechanism to secure or release the plugging device.
Figure 14:
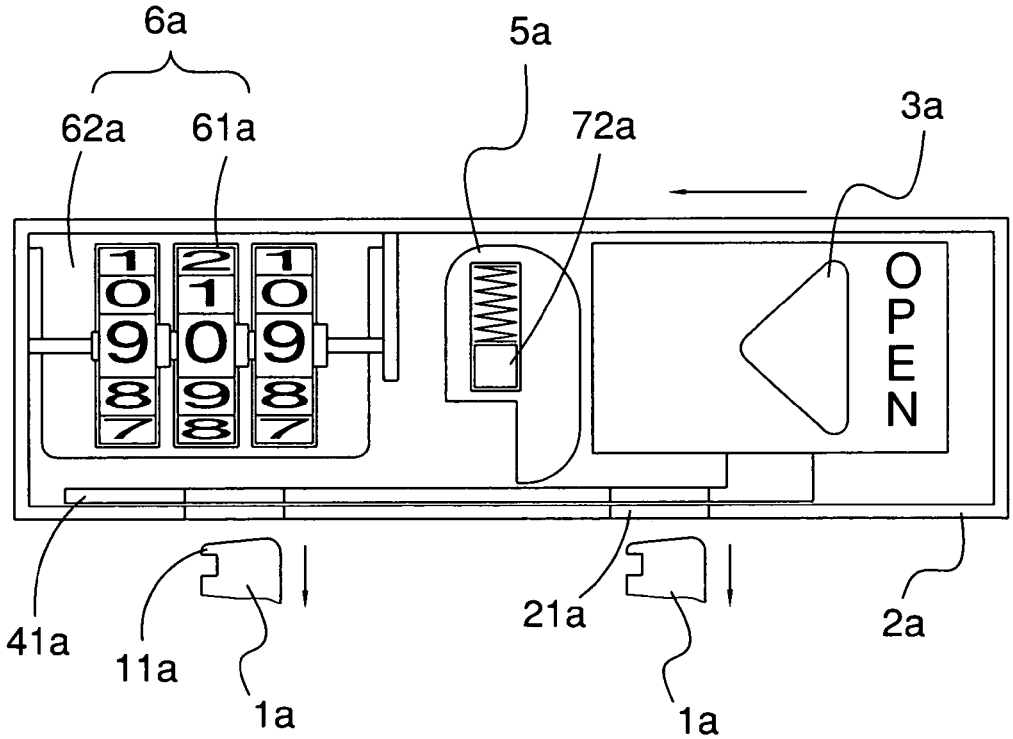
FIG. 14 is another cross sectional view of the second embodiment wherein the restriction device is rotated by a key to a position that the restriction device is departed from against the controlling device and the controlling device has driven the securing mechanism to release the plugging device.

With reference to FIG. 13 and FIG. 14, the plural number wheels 61*a* are not dialed to the unlocking numbers, the moving element 62*a* of the first locking means 6*a* remains still. A key (not shown) is inserted to the key operated locking means 7*a* and the key turns the rotor 72*a* together with the restriction device 5*a* to a vertical position that the restriction device 5*a* is neither against the moving element 62*a* nor against the controlling device 3*a*. Referring to FIG. 14, after the restriction device 5*a* is turned to a vertical position, the controlling device 3*a* is moved leftward along the second channel 22*a* and the securing mechanism 4*a* connected to the controlling device 3*a* releases the plugging devices 1*a*.

Numerous characteristics and advantages of the invention have been set forth in the foregoing description, together with details of the structure and function of the invention, and the novel features thereof are pointed out in appended claims. The disclosure, however, is illustrated only, and changes may be made in detail, especially, in matters of shape, size and arrangement of parts, materials and the combination thereof within the principle of the invention, to the full extend indicated by the broad general meaning of the terms in which the appended claims are expressed.

I claim:

1. A security lock comprising:

a lock body having a first channel and a second channel therein;

a plugging device being pluggable into said first channel;

a controlling device being slidably secured within said second channel;

a securing mechanism for securing or releasing said plugging device;

a restriction device slidably deposed within said second channel against said controlling device for controlling movement thereof;

a first locking means formed in said lock body for being engaged with or disengaged from said restriction device; and a second locking means formed in said lock body for rotating said restriction device to be disengaged from said first locking means;

wherein when the restriction device is disengaged from the first locking means, said controlling device can be moved to drive the securing mechanism to release said plugging device and when the restriction device is secured by the first locking means, said second locking means can be driven by a key to have said restriction device rotated to be disengaged from said first locking means.

2. The security lock of claim 1 wherein said restriction device has a cylinder surface, and a bottom surface having a cave therein, said cylinder surface having a gap therein, said gap having a narrow section and a wide section, said first locking means comprising a combination locking means with plural number wheels and a moving element, said moving element is movable when said plural number wheels are dialed to unlocking numbers, said second locking means being a key operated locking means having a body and a rotor extended therefrom and engaged with said cave of said bottom surface for rotating said restriction device to be engaged with or disengaged from said moving element of said first locking means wherein when said moving element is within said narrow section of the gap, the restriction device is engaged with said moving element and when said moving element is within said wide section of the gap, the restriction device is disengaged from said moving element.

3. The security lock of claim 2 further comprising a compression spring deposed on top of said body of said key operated locking means and against said bottom surface of said restriction device.

4. The security lock of claim 3 further comprising a cable connected to said plugging device with one end and connected to said controlling device with the other end.

5. The security lock of claim 4 wherein said securing mechanism has a securing element for securing or releasing said plugging device and a driving element engaged with said securing element for driving the same with a first end and engaged with said controlling device with a second end, said plugging device having a neck portion for being engaged with said securing element.

6. The security lock of claim 5, further comprising an ejecting mechanism installed in said first channel for ejecting said plugging device when said securing element is disengaged from said neck portion of said plugging device.

7. The security lock of claim 1 wherein said restriction device has a top surface having a cave therein, said first locking means comprising a combination locking means having a moving element and plural number wheels for controlling said moving element to be engaged with or disengaged from said restriction device, said moving element is disengaged from said restriction device when said plural number wheels are dialed to unlocking numbers, said second locking means being a key operated locking means having a body and a rotor extended therefrom, said rotor being engaged with said cave of said top surface for rotating said restriction device to be disengaged from first locking means whereby said restriction device is movable and said controlling device can drive said securing mechanism to secure or release said plugging device.

8. The security lock of claim 7 wherein said securing mechanism is connected to said controlling device.

9. The security lock of claim 8 further comprising a compression spring deposed within said cave of said top surface and being against an inner wall thereof with one end and against said rotor of said key operated locking means with the other end.

10. The security lock of claim 9 wherein said securing mechanism has a securing element connected to said controlling device for securing or releasing said plugging device, said plugging device having a hook portion for being engaged with said securing element.

* * * * *